US010451066B2

(12) United States Patent
Zaytsev

(10) Patent No.: US 10,451,066 B2
(45) Date of Patent: Oct. 22, 2019

(54) COMPRESSOR

(71) Applicant: GEA Refrigeration Germany GmbH, Berlin (DE)

(72) Inventor: Dmytro Zaytsev, Berlin (DE)

(73) Assignee: GEA REFRIGERATION GERMANY GMBH (DE)

( * ) Notice: Subject to any disclaimer, the term of this patent is extended or adjusted under 35 U.S.C. 154(b) by 229 days.

(21) Appl. No.: 15/102,108

(22) PCT Filed: Dec. 12, 2014

(86) PCT No.: PCT/EP2014/003344
§ 371 (c)(1),
(2) Date: Jun. 6, 2016

(87) PCT Pub. No.: WO2015/086160
PCT Pub. Date: Jun. 18, 2015

(65) Prior Publication Data

US 2016/0312778 A1 Oct. 27, 2016

(30) Foreign Application Priority Data

Dec. 12, 2013 (DE) ..... 10 2013 020 533

(51) Int. Cl.
*F04C 18/08* (2006.01)
*F04C 18/16* (2006.01)
(Continued)

(52) U.S. Cl.
CPC ..... *F04C 18/16* (2013.01); *F04C 27/02* (2013.01); *F04C 29/026* (2013.01); *F04C 2240/30* (2013.01); *F04C 2240/40* (2013.01)

(58) Field of Classification Search
CPC ..... F04C 29/026; F04C 29/02; F04C 18/084; F04C 27/02; F04C 18/16; F04C 28/125; B01D 46/10
(Continued)

(56) References Cited

U.S. PATENT DOCUMENTS 4,244,680 A * 1/1981 Ishizuka ..... B01D 46/10 418/97
4,342,547 A * 8/1982 Yamada ..... F01C 21/0863 418/84
(Continued)

FOREIGN PATENT DOCUMENTS

DE 198 45 993 A1 4/2000
DE 602 03 272 T2 2/2006
(Continued)

OTHER PUBLICATIONS

Search Report dated Oct. 29, 2014 in corresponding German Application No. 10 2013 020 533.6.
(Continued)

*Primary Examiner* — Deming Wan
(74) *Attorney, Agent, or Firm* — Ostrolenk Faber LLP

(57) ABSTRACT

A screw compressor (10) comprising a compressor device (18), in particular, at least one screw rotor (20, 22), which guides a compressed medium to an oil separating device (30). The compressor (10) has a first volume (32) and a second volume (34), in addition to a separating device (36) separating the first and the second volumes (32, 34) from each other. The first volume (32) is defined by a housing inner wall (52) and the separating device (36) which separates the first volume (32) from the second volume (34). The separating device (36) comprises a demistor (40) and an oil discharging device (54) is arranged on the separating device (36).

13 Claims, 2 Drawing Sheets

(51) Int. Cl.
*F04C 27/02* (2006.01)
*F04C 29/02* (2006.01)

(58) Field of Classification Search
USPC ..... 418/DIG. 1, 206.8, 84, 201.1, 97–99, 418/89–91, 95, 270
See application file for complete search history.

(56) References Cited

U.S. PATENT DOCUMENTS 4,478,054 A * 10/1984 Shaw ..... F04C 29/026 418/201.2
6,183,227 B1 * 2/2001 Hida ..... F04C 29/026 418/201.1
6,364,645 B1 * 4/2002 Dieterich ..... F01C 21/10 418/201.1
2010/0247361 A1 * 9/2010 Nemit, Jr. ..... F01C 21/007 418/83
2011/0182762 A1 * 7/2011 Feller ..... F04C 18/16 418/206.7
2013/0058822 A1 3/2013 Feller et al. ..... 418/84

FOREIGN PATENT DOCUMENTS

DE 10 2008 036 317 A1 2/2010
DE 10 2010 002 649 A1 9/2011
EP 1 379 786 B1 3/2005
JP 03015693 A * 1/1991 ..... F04C 29/026
WO WO 2010/012570 A2 2/2010

OTHER PUBLICATIONS

International Search Report and Written Opinion dated Feb. 10, 2015 in corresponding PCT International Application No. PCT/EP2014/003344.

* cited by examiner

COMPRESSOR

CROSS-REFERENCE TO RELATED APPLICATIONS

The present application is a 35 U.S.C. §§ 371 national phase conversion of PCT/EP2014/003344, filed Dec. 12, 2014, which claims priority to German Patent Application No. 10 2013 020 533.6, filed Dec. 12, 2013, the contents of which are incorporated herein by reference. The PCT International Application was published in the German language.

TECHNICAL FIELD OF THE INVENTION

The present invention relates to a screw compressor.

BACKGROUND OF THE INVENTION

There are both screw compressors which operate in a dry running operating mode and screw compressors which operate in an oil-flooded operating mode. In the latter screw compressors, oil plays a role both as a lubricant and as a sealant during the compression operation itself. In order, however, to avoid any undesired oil ingress into a refrigeration unit which is supplied with compressed refrigerant by the compressor, an oil separator is as a rule provided on a high pressure side of screw compressors of this type.

According to the prior art, an oil separator, for example of a semi-hermetic compact screw compressor, consists of two spaces or volumes separated by a demistor, also called a droplet separator or an aerosol separator made from metal knitted mesh. Compressed gas/oil mixture passes from a pressure pipe which is fed by a compression apparatus or compression unit in the form of at least one screw rotor into the first space or the first volume, in which an oil pre-separation takes place before it passes through the demistor.

Part of the oil is deposited on a bounding wall of the first volume and flows downward on said wall owing to inertia. It is disadvantageous that part of said oil flow passes into the vicinity of the demistor and is mixed again there with the compressed medium, for example refrigerant gas, since it is entrained accordingly by the gas flow.

SUMMARY OF THE INVENTION

Proceeding herefrom, it is the object of the present invention to specify a screw compressor which has an oil separation which is as efficient as possible.

This object is achieved by way of a screw compressor having the features disclosed herein.

The screw compressor which has a compression apparatus, in particular in the form of at least one screw rotor, which feeds a compressed medium to an oil separation apparatus is configured in such a way that:

- the compressor has a first volume, a second volume and a separation apparatus which separates the two volumes,
- the first volume is delimited by way of a housing inner wall and a separation apparatus which separates the first volume from the second volume, and
- the separation apparatus has a demistor.

Here, the compressed medium which can be, in particular, refrigerant (with an oil component) passes through the demistor from the first volume into the second volume. An oil discharge apparatus or oil collecting apparatus is arranged on the separation apparatus, which oil discharge apparatus or oil collecting apparatus prevents oil which has already been deposited on the housing inner wall of the first volume from being entrained again by the flowing compressed medium and therefore being mixed with the latter again.

BRIEF DESCRIPTION OF THE DRAWINGS

Further optional features of the invention are specified in the subclaims and the following description of the figures. The respective features which are described can be realized individually or in any desired combinations. Accordingly, the invention will be explained in the following text using exemplary embodiments with reference to the appended drawings, in which:

DESCRIPTION OF PREFERRED EMBODIMENTS

Figure 1:
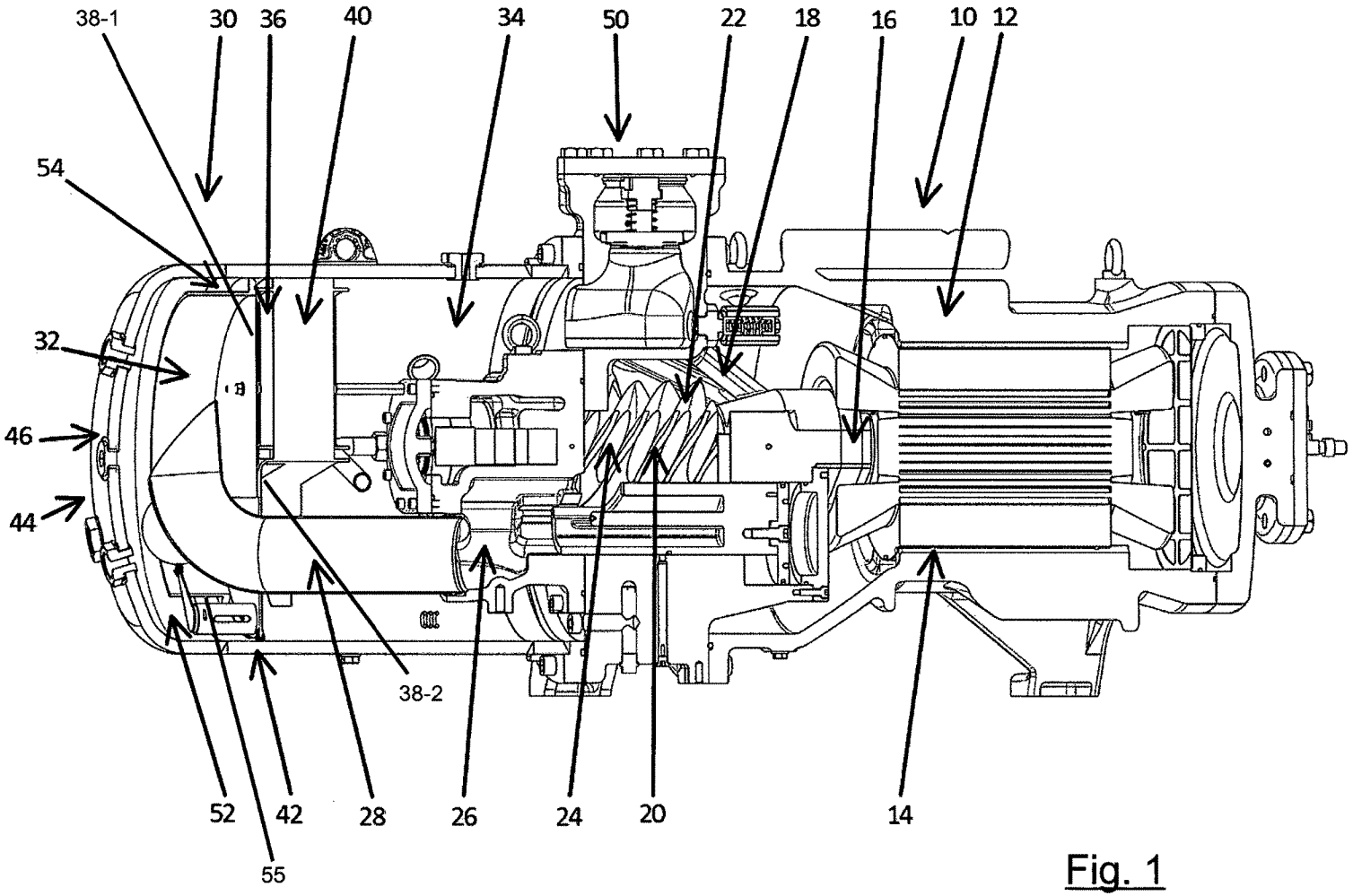
FIG. 1 shows a view of one exemplary embodiment of a compressor according to the invention.

FIG. 1 shows one possible embodiment of a compressor according to the invention, more precisely of a screw compressor 10 according to the invention which will also be called compressor 10 for short in the following text. The compressor 10 has a housing 12 and an electric motor 14 which is arranged in the housing 12. Furthermore, the compressor 10 has a drive shaft 16 and a compression apparatus 18 which has a screw rotor 20 and a second screw rotor 22 which is in engagement with the first screw rotor 20. The screw rotors 20, 22 are rotationally driven directly (indirectly in alternative embodiments, for example via a gear mechanism arrangement) via the drive shaft 16. As an alternative, a screw compressor 10 having only one screw rotor is also conceivable.

The first screw rotor 20 is arranged such that it can be rotated about a first rotational axis which is arranged in the axial direction. The second screw rotor is arranged such that it can be rotated about a second rotational axis which extends parallel to the first rotational axis. Both the first and the second screw rotor 20, 22 are arranged in a compression space 24 which is of fluid-tight configuration at least in sections with respect to the surroundings and opens into a high pressure volume 26.

The compressor 10 of the described embodiment operates in an oil-flooded operating mode, in which oil which is situated in the compressor 10 is used both as lubricant and (for example, during the compression operation itself) as a sealant. That is to say, the medium to be compressed, for example refrigerant, entrains oil, in particular in droplet form or as an aerosol, or is mixed with oil. After the compression operation which is brought about by way of the compression apparatus 18, the compressed medium/oil mixture (gas/oil mixture) is then fed via the high pressure volume 26 via a pressure pipe 28 to an oil separation apparatus 30.

To this end, the compressor 10 has a first volume 32 in the form of a first chamber and a second volume 34 in the form of a second chamber, the first volume 32 and the second volume 34 being separated by way of a separation apparatus 36 which has a separating wall 38. The separating wall has a first separating wall section 38-1 in the form of a perforated plate and a second separating wall section 38-2 which is connected to the first separating wall section 38-1 and is configured as a material section without a cutout. Whereas the first separating wall section 38-1 is arranged in an upper region of the compressor 10 or the first volume 32, the second separating wall section 38-2 is arranged in a lower region of the compressor. A demistor 40 is arranged in or on the separating wall 38. The first volume 32 has an approximately cylindrical housing side wall 42 which is delimited by way of an end wall 46 at a first end 44 and by way of the separation apparatus 36, in particular separating wall 38, at a second end 48 which lies opposite the end wall 46. From the second volume 34, the compressed medium then passes to a compressor outlet 50, from where it is available to the respective desired application.

An oil pre-separation takes place in the first volume 32, into which the compressed medium including the entrained oil is introduced via the pressure pipe 28. Here, oil is deposited on a housing inner wall 52 of the first volume 32. In order to prevent oil which has already been deposited on the housing inner wall 52 from being entrained again by the flowing compressed medium, an oil discharge apparatus or oil outlet apparatus or oil collecting apparatus 54 is arranged on the separation apparatus 36, in particular separating wall 38.

Further oil which is mixed with the flowing compressed medium is then separated when passing through the demistor 40 which, for this purpose, has a metal knitted mesh or metal braid which is arranged in the region, through which flow passes. It is to be noted at this point that, for example, a lamella construction would also be conceivable instead of a metal or wire knitted mesh. A metal or wire knitted mesh ensures a construction which is insusceptible to faults and has a long service life, however.

As has been mentioned in the above text, the first volume 32 is of approximately cylindrical configuration, with the result that the separating wall 38 with the demistor 40 (that is to say, the separating wall 38, on which the demistor 40 is arranged) has approximately a circular basic area. As an alternative, other configurations (rectangular, hexagonal or octagonal or provided with a large number of corners) are also conceivable; the approximately circular configuration is, however, often to be preferred, in particular, for pressure vessels. The oil discharge apparatus or oil collecting apparatus 54 is of channel-shaped configuration and extends from a radially outer end of the separation apparatus 36, in particular separating wall 38, inward.

The oil discharge apparatus or oil collecting apparatus 54 which is configured in the form of a channel has a border 56, in particular wall, which is configured with an approximately L-shaped cross section, which border is arranged at or on the separation apparatus 36, in the embodiment which is described in the above text, arranged at or on the separating wall 38, and which border is in contact with the housing side wall 42 or the housing inner wall 52 which forms a lateral border of the oil discharge apparatus or oil collecting apparatus 54, with the result that the latter overall has a channel shape (an approximately U-shaped cross section). The oil discharge apparatus or oil collecting apparatus 54 extends over a segment-like section, more precisely a circular segment-like section of the separating wall 38. Where the oil discharge apparatus or oil collecting apparatus 54 is not configured, the oil which accumulates therein can run off into an oil sump which is situated in the compressor. That is to say, the oil discharge apparatus or oil collecting apparatus 54 is not configured or is cut out on a side which is situated at the bottom during operation of the compressor 10 in a (circular) sector of from 20° to 90°, preferably of from 60° to 80° inclusive. That is to say, in other words, the oil discharge apparatus or oil collecting apparatus 54 has a sector angle of from 270° to 340°, preferably from 280° to 300°. In the specifically described embodiment, the sector angle is 290°.

In the embodiment which is described, the oil discharge apparatus or oil collecting apparatus 54 is arranged completely in the first volume 32. The oil discharge apparatus or oil collecting apparatus 54 has an oil outlet or oil exit or an oil outlet opening 55 which is arranged in the first volume 32, in particular therefore opens there. The oil which is collected or discharged by way of the oil discharge apparatus or oil collecting apparatus 54 is thus conducted away or discharged into the first volume 32.

Figure 2:
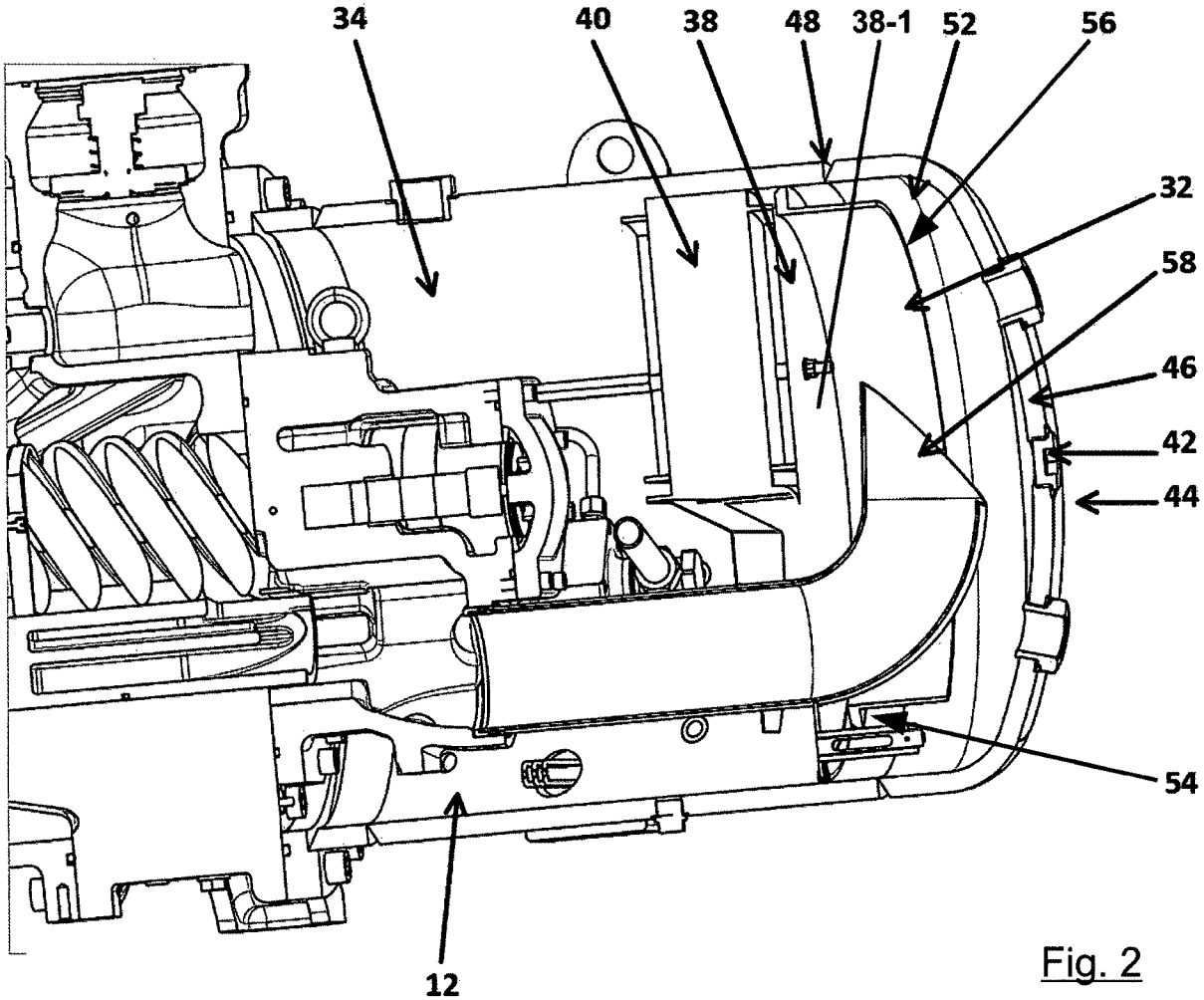
FIG. 2 shows an enlarged illustration of a part section from FIG. 1.

It is to be noted at this point that, in alternative embodiments, the oil discharge apparatus or oil collecting apparatus 54 can also be configured on or in the separating wall 38 and/or the demistor 40, for example as a depression or else in the form of a location of reduced material accumulation, for example a groove. The embodiment according to FIG. 1 and FIG. 2 which is described in the above text ensures an effective construction, however, in which an optimum oil discharge is ensured.

It remains to be mentioned that the pressure pipe 28 for feeding in the compressed medium which extends into the first volume 32 has a 90° bend in said first volume and is beveled at its outlet 58 toward the side which faces away from the separation apparatus 36, with the result that as great an inner wall region of the first volume 32 as possible is subjected to flow. This facilitates the oil pre-separation.

In summary, it can be noted that an oil discharge apparatus or oil collecting apparatus 54 (oil collecting collar) is provided according to the invention, in order to avoid oil which has already been deposited being remixed with the gas at the demistor 40. Together with the inner side of the housing wall of the first volume 32, the oil collecting collar forms an oil outflow duct, by way of which the oil which flows along the wall is collected upstream of the demistor 40 and is conducted downward to the oil sump.

Although the invention is described using embodiments with fixed combinations of features, it also comprises the conceivable further advantageous combinations, however, as specified, in particular but not exhaustively, by the subclaims. All of the features which are disclosed in the application documents are claimed as being essential to the invention, insofar as they are novel over the prior art individually or in combination.

LIST OF DESIGNATIONS

10 Compressor
12 Housing
14 Electric motor
16 Drive shaft
18 Compression apparatus
20 First screw rotor
22 Second screw rotor
24 Compression space
26 High pressure volume
28 Pressure pipe
30 Oil separation apparatus
32 First volume
34 Second volume
36 Separation apparatus
38 Separating wall
38-1 First separating wall section
38-2 Second separating wall section
40 Demistor
42 Housing side wall

44 First end of the housing side wall 42
46 End wall
48 Second end of the housing side wall 42
50 Compressor outlet
52 Housing inner wall
54 Oil discharge apparatus or oil collecting apparatus
55 Oil outlet or oil exit or oil outlet opening
56 Border or wall
58 Outlet of the pressure pipe 28

The invention claimed is:

1. A screw compressor comprising:

a screw rotor configured to feed a compressed medium to an oil separation apparatus;

a first volume, a second volume, and a separation apparatus which separates the first and the second volume from one another, the first volume being delimited by way of a housing inner wall and the separation apparatus;

the separation apparatus comprising a demistor; and an oil discharge apparatus arranged on the separation apparatus, wherein the oil discharge apparatus extends over only a segment or an angular range of the separation apparatus of from 270° to 340°.

2. The compressor as claimed in claim 1, wherein the oil discharge apparatus is configured in a form of a channel.

3. The compressor as claimed in claim 1, wherein the first volume has an approximately cylindrical housing side wall which is delimited by way of an end wall at a first end and by way of the separation apparatus at a second end which lies opposite the end wall, wherein the oil discharge apparatus is arranged so as to extend inward from a radially outer end of the separation apparatus.

4. The compressor as claimed in claim 1, wherein the oil discharge apparatus comprises a wall with an L-shaped cross section.

5. The compressor as claimed in claim 4, wherein the border wall is arranged on the separation apparatus and is in contact with the housing inner wall.

6. The compressor as claimed in claim 1, wherein the oil discharge apparatus extends over a circular sector or circular sector section of the separation apparatus.

7. The compressor as claimed in claim 6, wherein the oil discharge apparatus extends over only a segment or an angular range of the separation apparatus of from 280° to 300°.

8. The compressor as claimed in claim 6, wherein the oil discharge apparatus extends over only a segment or an angular range of the separation apparatus of from 290° to 300°.

9. The compressor as claimed in claim 1, wherein a pressure pipe for feeding in the compressed medium extends into the first volume, and has a 90° bend in said first volume.

10. The compressor as claimed in claim 9, wherein the pressure pipe is beveled toward a side which faces away from the separation apparatus.

11. The compressor as claimed claim 1, wherein the demistor comprises a metal knitted mesh.

12. The compressor as claimed in claim 1, wherein the oil discharge apparatus has an oil outlet arranged in the first volume.

13. The compressor as claimed in claim 1, wherein the oil discharge apparatus is arranged completely in the first volume.

* * * * *